US010294055B2

(12) United States Patent
Dettori et al.

(10) Patent No.: US 10,294,055 B2
(45) Date of Patent: May 21, 2019

(54) REWINDING MACHINE AND REWINDING METHOD

(71) Applicant: UNIVERSAL TISSUE TECHNOLOGY S.R.L., Lucca (IT)

(72) Inventors: Daniele Dettori, Capannori (IT); Giovanni Bertoli Barsotti, Buggiano (IT); Gionata Pardini, Viareggio (IT)

(73) Assignee: MTORRES TISSUE S.R.L. (IT)

( * ) Notice: Subject to any disclaimer, the term of this patent is extended or adjusted under 35 U.S.C. 154(b) by 235 days.

(21) Appl. No.: 15/314,974

(22) PCT Filed: May 28, 2015

(86) PCT No.: PCT/EP2015/061917
§ 371 (c)(1),
(2) Date: Nov. 30, 2016

(87) PCT Pub. No.: WO2015/181339
PCT Pub. Date: Dec. 3, 2015

(65) Prior Publication Data

US 2017/0233207 A1 Aug. 17, 2017

(30) Foreign Application Priority Data

May 30, 2014 (IT) ..... BO2014A0319

(51) Int. Cl.
*B65H 19/26* (2006.01)
*B65H 19/22* (2006.01)
(Continued)

(52) U.S. Cl.
CPC ..... *B65H 19/2269* (2013.01); *B65H 18/22* (2013.01); *B65H 19/26* (2013.01); *B65H 19/28* (2013.01); *B65H 19/305* (2013.01)

(58) Field of Classification Search
CPC ..... B65H 19/26; B65H 19/28; B65H 19/305; B65H 19/2269; B65H 18/22
See application file for complete search history.

(56) References Cited

U.S. PATENT DOCUMENTS 7,896,284 B2 * 3/2011 Morelli ..... B65H 19/2269 242/532.1
7,931,226 B2 * 4/2011 Benvenuti ..... B65H 19/2269 242/521

(Continued)

FOREIGN PATENT DOCUMENTS

WO 2011117827 A1 9/2011

OTHER PUBLICATIONS

International Search Report and Written Opinion dated Sep. 11, 2015 by EPO/ISA, International Application No. PCT/EP2015/061917, 9 pages.

*Primary Examiner* — Sang K Kim
(74) *Attorney, Agent, or Firm* — Ware, Fressola, Maguire & Barber LLP

(57) ABSTRACT

A rewinding machine for the production of rolls of web material wound around winding cores includes: a winding cradle, including peripheral winding members of the rolls; a feeding path of the web material towards the winding cradle; an insertion channel for inserting the winding cores towards the winding cradle, having an entrance inside which the winding cores are introduced and an exit toward the winding cradle, the insertion channel being defined between a rolling surface and a continuous flexible member, provided with a forward movement; an inserter for inserting the winding cores into the inserting channel. At the entrance of the insertion channel a pressing device is arranged, said pressing device projects toward the inside of the insertion channel and toward the continuous flexible member. The pressing (Continued)

device is arranged and configured to press the winding cores entering the insertion channel towards the continuous flexible member.

22 Claims, 11 Drawing Sheets

(51) Int. Cl.

| | |
|---|---|
| ***B65H 19/30*** | (2006.01) |
| ***B65H 18/22*** | (2006.01) |
| ***B65H 19/28*** | (2006.01) |

(56) References Cited

U.S. PATENT DOCUMENTS

| | | | | |
|---|---|---|---|---|
| 8,267,344 | B2 * | 9/2012 | Maddaleni ..... | B65H 19/2269<br>242/532.1 |
| 2009/0272835 | A1 | 11/2009 | Benvenuti | |

* cited by examiner

1
N
13
P
15
17
39
31
35
27
5
5A
29
33
19A
45
A2
26
A3
23
23A
3
f5
27
56
26A
25B
21
19
11
49
53C
19B
53P
54
f7
7A
53
41
23A
f9
9A
A1
R1
7
9
55
10
10A

REWINDING MACHINE AND REWINDING METHOD

TECHNICAL FIELD

The invention relates to the field of paper converting machines, in particular but not exclusively for tissue paper converting. More particularly, the invention relates to improvements to rewinders for producing rolls or logs of web material wound around tubular winding cores.

PRIOR ART

For the production of rolls of toilet paper, towel paper or similar rewinding machines are used, which rewind the web material coming from a parent reel, produced in the paper mill, on rolls or logs whose diameter is equal to the final diameter of the rolls of toilet paper for consumption, and whose length is a multiple of the length of the latter. These logs or rolls are subsequently cut into a plurality of rolls of smaller axial dimensions, which are packaged and placed for sale.

The modern rewinding machines are based on the principle of the peripheral winding, where the roll during the formation is retained in rotation in a winding cradle defined by peripheral winding members, typically a cluster of winding rollers which rotate all in the same direction and which are in contact with the outer surface of the roll being formed. The web material is fed around one of the winding rollers and is gradually wound around the tubular winding core forming the roll or the log.

Once the roll or the log has reached the required diameter, or once a predetermined amount of web material has been wound, the roll is unloaded from the winding cradle and replaced with a new winding core on which winding of the web material starts again. Said exchange operation, takes place at high speed, normally without slowing down the speed of the web material fed to the winding cradle. In the exchange step is therefore necessary the interruption of the web material, to generate a final edge of the roll to be formed and an initial edge or leading edge that must be wound on the new winding core, which is inserted in the rewinding machine. The anchoring of the initial free edge is obtained in some cases through an adhesive, in other cases by means of other systems, for example with air jets which are such that the leading edge forms the first turn around the new winding core.

Different systems were studied for carrying out the exchange step in a rewinding machine in a fast and efficient manner.

WO 2011/117827 discloses a rewinding machine in which the new tubular winding cores are inserted towards the winding cradle by an insertion channel placed upstream of a pair of winding rollers. The pair of winding rollers defines there between a feeding nip for the web material. The insertion channel is formed between a stationary rolling surface, along which the new cores are rolled, and an opposite flexible feeding member, typically a series of endless belts, returned around the first winding roller and around a tear roller or severing roller. The arrangement is such that the flexible member is placed at a distance from the rolling surface such that the new cores are inserted in the insertion channel in contact both with the rolling surface, and with the web material that advances in turn in contact with the continuous flexible member. To start rolling of the winding cores, the height of the insertion channel is slightly lower than the diameter of the winding core, which is then slightly compressed and angularly accelerated due to the advancing speed of web material and of the lying behind continuous flexible member. The latter is returned around the severing roller, whose peripheral speed of rotation is slightly lower than the peripheral speed of rotation of the remaining winding rollers.

When a new winding core is introduced in the insertion channel into contact with the rolling surface and with the web material in turn in contact with the continuous flexible member, as the latter advances at a speed less than the advancing speed of the web material and the speed of rotation of the winding rollers, the pressure exerted by the new winding core causes the traction of the web material between the point of contact with the new winding core and the roll in the completion phase. This traction leads to the breakage or to the tearing of the web material between the pinch point with the new winding core and the winding point on the roll in the completion phase.

After breakage of the web material, the leading edge that is so formed is wound on the new winding core that, rolling along the insertion channel, is finally inserted in the winding cradle passing through the nip between the pair of winding rollers.

This exchange system has proved to be particularly effective, but can be further improved in particular to take account of dimensional tolerances of the winding cores which, being made of cardboard, may have also a considerably variable size from one core to another core.

SUMMARY OF THE INVENTION

According to a first aspect, a rewinding machine for the production of rolls of web material wound around winding cores is provided, comprising:

- a winding cradle, comprising peripheral winding members, for example a set of three winding rollers;
- a feeding path of the web material towards the winding cradle;
- an insertion channel of winding cores into the winding cradle, having an entrance, in which the winding cores are inserted, and an exit towards the winding cradle, the insertion channel being defined between a rolling surface and a continuous flexible member, provided with a feeding motion. At the entrance of the insertion channel a pressing device is placed, which can protrude toward the inside of the insertion channel toward the continuous flexible member. The pressing device is advantageously arranged and configured to press the winding cores entering the insertion channel toward the continuous flexible member.

According to a further aspect, a rewinding machine for the production of rolls of web material wound around winding cores is provided, comprising:

- a winding cradle, comprising peripheral winding member, for example a set of three winding rollers;
- a feeding path of the web material towards the winding cradle;
- an insertion channel of winding cores toward the winding cradle, having an entrance, in which the winding cores are inserted, and an exit towards the winding cradle, the insertion channel being defined between a rolling surface and a continuous flexible member, provided with a feeding movement and guided around a winding roller forming part of the winding cradle and around a severing roller, placed at the entrance of the insertion channel. The rewinding machine also comprises a pressing device, arranged substantially at the entrance of the insertion channel of the winding cores and configured to press the winding cores entering the insertion channel against the severing roller, so that the winding cores are pressed between the severing roller and the pressing device.

In practice, the pressing device defines a kind of obstruction at the entrance of the insertion channel, which serves to facilitate the initial angular acceleration of the winding cores and to sever the web material, as will be below explained in detail with reference to an exemplary embodiment.

In some embodiments the pressing device is stationary with respect to the rolling surface and with respect to the flexible member, or with respect to the axis of the severing roller. Advantageously, however, the position of the pressing device can be adjustable. The adjusting allows setting the transversal dimension of the insertion channel at the inlet thereof. By increasing or reducing the protrusion of the pressure device in the insertion channel the interference between winding core and pressure device is increased or reduced. This adjustment is advantageously independent from any other adjustments, the rewinding machine can be provided with.

In some embodiments the rolling surface of the winding cores can have an adjustable distance from the continuous flexible member, so as to adapt the transversal dimension, namely the height of the insertion channel of the cores to the diameter of the cores. In some embodiments this adjustment is combined with the adjustment of the center distance between a first winding roller and a second winding roller that can be part of the winding cradle and that can be placed at the exit of the insertion channel of the cores. For example the adjustment of the center distance between the winding rollers, which also defines the dimension of a passage nip of the winding cores towards the winding cradle, can take place simultaneously with the adjustment of the mutual position between the rolling surface and continuous flexible member.

Advantageously, the adjustment of the position of the pressing device can be independent from the adjustment of the distance between the first and the second winding roller, between which the transit nip of the winding cores is defined. Advantageously, the adjustment of the position of the pressing device respect to the continuous flexible member can be independent from the adjustment of the position of the rolling surface.

With the independent adjustments mentioned above it is possible to adjust the dimension of the insertion channel of the cores regardless of the dimension of the entrance of said channel, that is, from the position of the pressing device with respect to the rolling surface. It is so possible, for example, to increase or to decrease the effect of initial pressing to which the winding core at the entrance of the insertion channel is subjected, regardless of the transversal dimension between (i.e. from the height) of the channel, regardless of the diametric dimension of the core, and regardless of the interference or pressing status between the core and the roller in initial winding step and the winding rollers between which the nip is defined, through which the winding core to be insert in the winding cradle passes.

The continuous flexible member can be driven into motion by the winding roller around which it is guided, so as to have a feeding speed equal to the winding speed, i.e. to the speed of the winding roller. The severing roller can be driven to rotate at a peripheral speed so that, at least in an inserting step of a core into the insertion channel, the peripheral speed of the severing roller is lower than the peripheral speed of the winding roller and to the speed of the continuous flexible member. The severing roller is associated to guiding members of the continuous flexible member that allow said continuous flexible member to have a feeding speed different from the peripheral speed of the severing roller and corresponding to the winding speed.

In other embodiments the continuous flexible member is driven by the severing roller and moves at a speed lower than the winding speed, at least during the step of inserting the new winding core and of interruption of the web material.

The winding cradle can comprise for example a cluster of peripheral winding rollers, typically three peripheral winding rollers, of which one at least has a movable axis to allow the growth of the roll into the winding cradle. The other two winding rollers may define a nip, through which the web material passes and through which the web material is fed. The nip can be arranged at the exit of the insertion channel of the winding cores. The continuous flexible member is guided around one of said winding rollers.

In advantageous embodiments, the pressing device comprises a plurality of pressing elements mutually aligned generally parallel to the axes of the winding rollers and to the axis of the severing roller. Advantageously, the pressing elements can be movable independently one to another and each provided with at least one resilient biasing member that biases the respective pressing element in said idle position. In this manner a better pinching effect of the web material by the winding core which is inserted into the rewinding machine is obtained, even if the winding core has defects in shape or diameter variations along its axial development. The use of pressing elements resiliently biased to press the winding core against the severing roller, furthermore, ensures a substantially constant pressure even with winding cores of different stiffness. In other words, the winding cores that are more or less hard and resistant to crushing are pressed against the severing roller in a uniform manner, with a substantially constant deformation, obtaining a more easily repeatable pinching effect. A higher contact and friction surface on the winding core and consequently a greater angular acceleration of the winding core in the exchange step are also obtained.

In some embodiments, the rewinding machine comprises a winding core feeding system, which feeds the winding cores towards the insertion channel and which can comprise: a conveyor which feeds the winding cores in a waiting position in front the entrance of the insertion channel; and an inserter of winding cores which transfers the winding cores from the waiting position into the entrance of the insertion channel, forcing them between the pressing device and the continuous flexible member or against the severing roller.

According to a further aspect, the invention relates to a method for producing rolls of web material wound around winding cores, comprising the steps of:

- providing a winding cradle, comprising peripheral winding members of the rolls;
- providing a feeding path of the web material toward the winding cradle;
- providing an insertion channel of winding cores toward the winding cradle, having an entrance, in which the winding cores are inserted, and an exit toward the winding cradle, the insertion channel being defined between a rolling surface and a continuous flexible member, provided with a feed movement;
- providing a pressing device at the entrance of the insertion channel of the winding cores;
- feeding the web material along the feeding path of the web material toward the winding cradle and winding a first roll of web material around a first winding core;

when a roll of web material has been wound, conveying a new winding core toward the entrance of the insertion channel;

pressing the new winding core toward the continuous flexible member by means of the pressing device.

According to a further aspect, the invention relates to a method for producing rolls of web material wound around winding cores, comprising the steps of:

providing a winding cradle, at least a winding roller;

providing an insertion channel of winding cores toward the winding cradle having an entrance, in which the winding cores are inserted, and an exit toward the winding cradle, the channel being defined between a rolling surface and a continuous flexible member, provided with a forward movement, guided between the winding roll which rotates at a peripheral speed corresponding to a winding speed of the web material, and a severing roller arranged at the entrance of insertion channel;

arranging a pressure device at the entrance of the insertion channel;

feeding the web material along a feeding path of the web material toward the winding cradle and winding a first roll of web material around a first winding core;

when the first roll wound is completed, inserting a second winding core into the entrance of the insertion channel, forcing the second winding core between the pressing device and the severing roller;

severing the web material due to the effect of a difference between the winding speed and the peripheral speed of the severing roller.

Further possible features and embodiments of the rewinding machine and the rewinding method are described in the following, with reference to embodiments of the invention, and in the attached claims, which form an integral part of the present description.

BRIEF DESCRIPTION OF THE DRAWINGS

The invention will be better comprised following the description and the attached drawings, which show a practical embodiment of a rewinding machine according to the invention. In particularly, in the drawing.

DETAILED DESCRIPTION OF THE EMBODIMENTS OF THE INVENTION

The following detailed description of exemplary embodiments refers to the accompanying drawings. The same reference numbers in different drawings identify the same or similar elements. Furthermore, the drawings are not necessarily in scale. The following detailed description does not limit the invention. Rather, the object of the invention is defined by the accompanying claims.

The reference throughout the description to "one embodiment" or "the embodiment" or "some embodiments" means that a particular feature, structure or element described in relation to an embodiment is comprised in at least one embodiment of the object described. Therefore the phrase "in one embodiment" or "in the embodiment" or "in some embodiments" in various points along the description refers not necessarily to the same or to the same embodiments. Moreover, the particular characteristics, structures or elements can be combined in any suitable manner in one or more embodiments.

Figure 1:
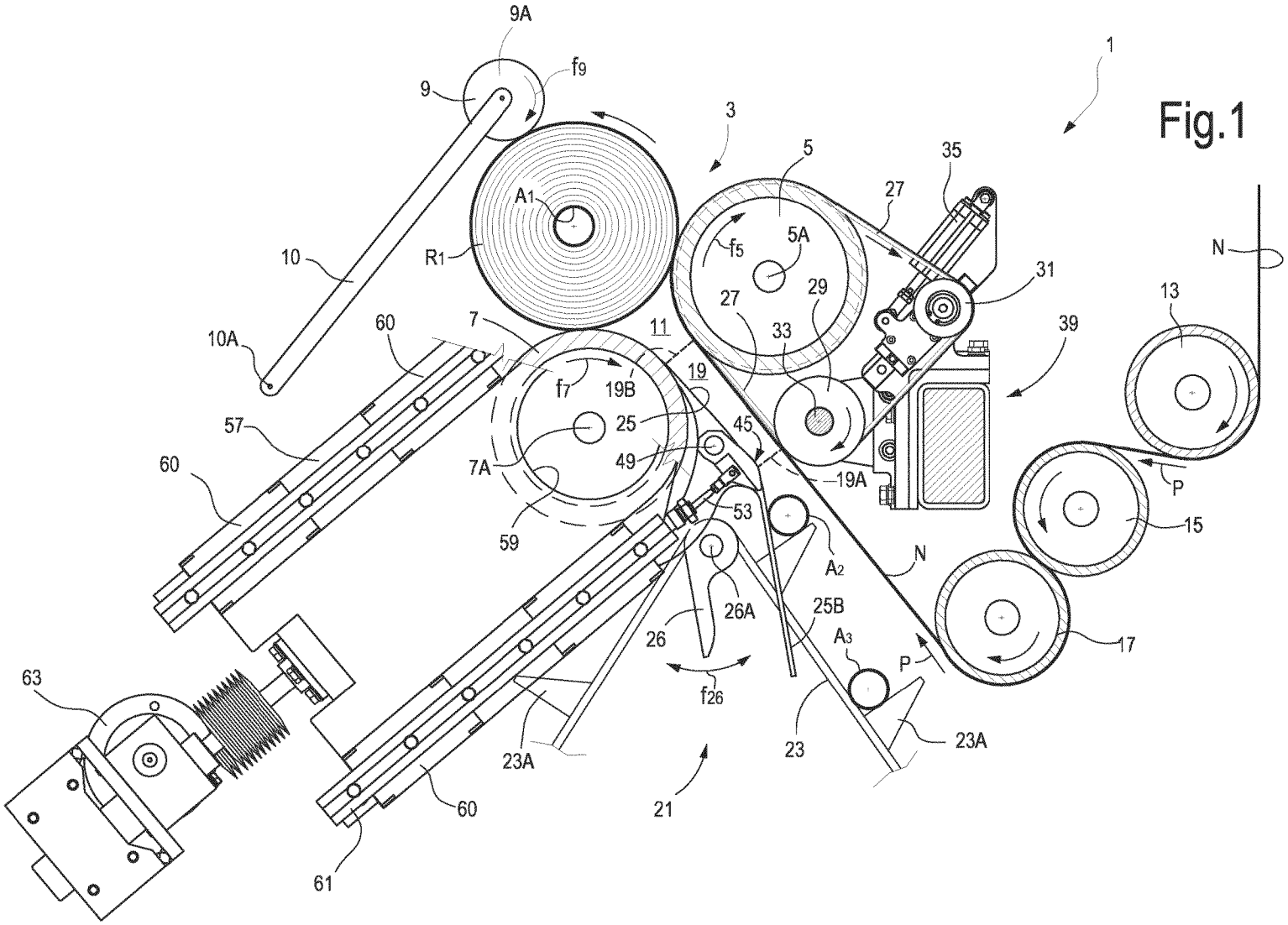
FIGS. 1-8 show, in a simplified side view, the rewinding machine in various steps of the winding cycle.

FIG. 1 illustrates a rewinding machine in a possible embodiment in a schematic side view. The rewinding machine, indicated with numeral 1, is limited shown only to the main components, useful for the understanding the various and innovative aspects and the operation thereof.

In one embodiment the rewinding machine 1 comprises a winding cradle 3, in which rolls or logs of web material R are formed. The rolls are formed by winding a web material N around winding cores A, generally of tubular shape. For example the winding cores A can be made of cardboard or plastic. In general the winding cores A have a structure so that they can be slightly diametrically deformed in elastic manner, for the purposes clarified below. In FIG. 1 a roll R1 is ending its winding around a winding core A1 in the winding cradle 3.

In the illustrated embodiment, the winding cradle 3 is constituted by peripheral winding members. For example, the peripheral winding members can comprise a first winding roller 5, rotating around an axis 5A, a second winding roller 7, rotating around a rotation axis 7A, and a third winding roller 9 rotating around a rotation axis 9A. The rotation axes of the winding rolls are suitably substantially parallel. The winding roller 9 is appropriately supported with its mobile axis 9A, to follow the growth of the roll R under formation in the winding cradle formed by the winding rollers 5, 7, 9. For example, the winding roller 9 can be supported by arms 10 articulated in 10A to a fixed structure (not shown).

In FIG. 1 with f5, f7 and f9 are shown the directions of rotation of the winding rollers 5, 7 and 9, respectively, the winding rollers 5, 7 and 9 are in contact with the roll R1 and, due to friction between the cylindrical surfaces of the winding rollers 5, 7 and 9 from one side and the cylindrical surface of the roll R1 on the other side, the latter is held in rotation, so that around it is wound the web material N.

Between the first winding roller 5 and the second winding roller 7 a nip 11 is defined, through which a feeding path of the web material extends, indicated by the arrow P, which also indicates the feeding direction of the web material itself.

Upstream of the winding cradle 3, the feeding path P of the web material N can be defined for example by a series of guide rollers 13, 15, 17, represented by way of example in FIG. 1. The web material N can be perforated along transversal perforation lines by an upstream perforator unit, not shown. The perforation lines divide the web material N into individual portions or sheets that can be mutually separated at the time of use.

Upstream of the groove 11 and of the winding cradle 3 an insertion channel 19 of the winding cores is defined, which are supplied to the winding zone by a suitable supply system 21.

In the illustrated embodiment, the supply system 21 comprises a conveyor 23, for example including one or more chains or other flexible continuous bodies, guided around a closed path and moved by a motor, not shown. Along the conveyor chains 23 pushers 23A are provided, which push the winding cores A toward an entrance of insertion channel 19 of winding cores.

In FIG. 1 a second winding core A2 is shown in a waiting position, before being inserted into the insertion channel 19. A further winding core A3 is placed along the conveyor 23 upstream of the winding core A2, with respect to the feeding direction of the cores along the path defined by the chains 23.

In advantageous embodiments, each winding core A (A1, A2, A3) is inserted into the insertion channel 19 by means of an inserter 26. In some embodiments the inserter 26 can rotate about an axis 26A with a reciprocating movement according to the double arrow f26, as described in more detail below with reference to the sequence of FIGS. 1-8. In other embodiments the inserter 26 can be provided with a continuous rotation movement at appropriately variable speed.

In the scheme of FIG. 1, 19A designates the entrance of the channel 19 and 19B designates the exit of channel 19, advantageously positioned in or in front of the nip 11, between the first winding roller 5 and the second winding roller 7.

In advantageous embodiments, the insertion channel 19 is delimited by a rolling surface 25 which extends between the entrance 19A and the exit 19B. On the opposite side to the rolling surface 25, the channel 19 can be defined by a continuous flexible member 27. In some embodiments the continuous flexible member 27 can comprise one or more belts or other continuous flexible elements 27A (see in particular FIG. 11) forming a closed path, and they are guided around the first winding roller 5, a severing roller 29 and a take-up roller 31. The number 35 indicates a cylinder-piston actuator which can be used to tighten the continuous flexible elements 27A forming the continuous flexible member 27.

In some embodiments the rolling surface 25 can be flat. In other embodiments, the rolling surface 25 can be slightly rounded to compensate the flexure of the flexible member 27 in the stretch between the winding roller 5 and the severing roller 29. In this way a constant interference with the tubular winding core that advances along the insertion channel 19 is ensured.

In the embodiment described here the flexible elements 27A that form the continuous flexible member 27 are moved by the severing roller 29 and they can be guided around the winding roller 5, which is configured so that the flexible elements 27A guided there around can have a speed independent from the peripheral speed of the winding roller 5. An embodiment of the winding roller that allows this operation will be described later with reference to FIG. 11. In this case the continuous flexible elements 27A are moved by the separation roller 29. In a different embodiment, described with specific reference to FIG. 12, it is provided that the flexible elements 27A are moved by the winding roller 5, and that the severing roller 29 can have a peripheral speed independent from that of the continuous flexible elements 27A.

In some embodiments the severing roller 29 and the take-up roller 31 can be configured as a series of coaxial pulleys. Each pulley can guide one of the flexible elements 27A that form the continuous flexible member 27. Advantageously, in this case the pulleys that form the severing roller 29 are mutually coaxial and for example can be keyed on a common shaft. Their peripheral speed can correspond to the speed of the continuous flexible elements 27A. The pulleys that form the take-up roller can be supported also independently one from the other, to tension each belt or other continuous flexible element in an optimal way independently of the other.

In other embodiments, described in greater detail later, the severing roller 29 can be formed by portions of roller keyed on a common shaft, between which pulleys are provided for guiding the belts or other flexible elements 27A forming the continuous flexible member 27, to allow the latter to move at a speed different from the peripheral speed of the severing roller 29.

In some embodiments, the severing roller 29 is motorized. If the severing roller 29 is formed of several coaxial pulleys or coaxial portions of the roller, these can be mounted on a common shaft 33 that can be rotated by a motor, not shown. In other embodiments the motion to the belts 27A can be provided by other rollers arranged along the closed path defined by the belts 27A forming the continuous flexible member 27, for example by the take-up roller 31.

In advantageous embodiments, the severing roller 29 and the take-up roller 31 with the respective actuator 35 can be carried by a beam 39.

The winding roller 5 can be advantageously configured in such a way that the continuous flexible elements 27A that form the continuous flexible member 27 are guided there around in such a way as to be able to move with a speed different than the peripheral speed of the winding roller 5.

Figure 11:
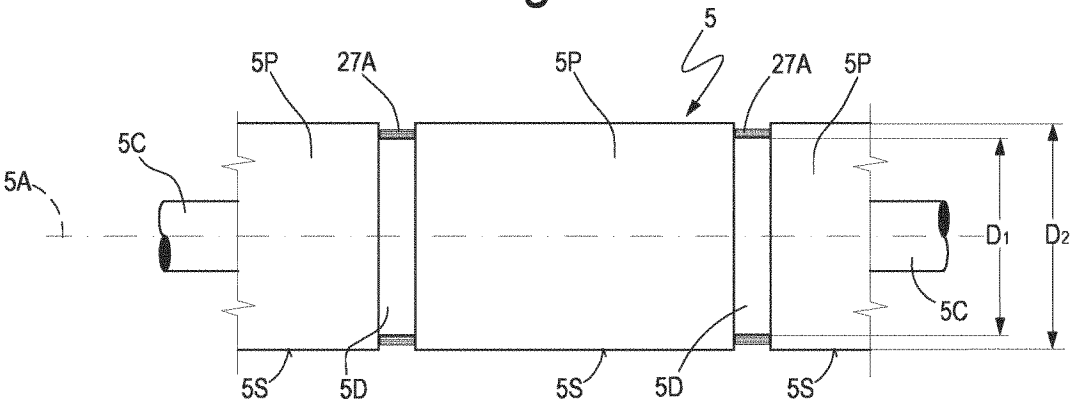
FIG. 11 shows a partial schematic side view of the first winding roller and of the two belts forming parts of the continuous flexible member, guided around said winding roller, in an embodiment of the rewinding machine described herein.

For this purpose, as schematically indicated in FIG. 11, the winding roller 5 can be constituted by a plurality of portions 5P, each of which has a cylindrical surface 5S. The cylindrical surfaces 5S are mutually coaxial and together form the surface of transmission of the rotation motion and of the winding motion to the roll R which is formed in the winding cradle 3. The various portions 5P in which the roller 5 is divided can be keyed on a motorized internal shaft 5C. Between two contiguous portions 5P of the winding roller 5 a disc 5D can be placed, which is directly or indirectly idly supported on the drive shaft 5C. The continuous flexible elements 27A are guided around the disks 5D. Since the latter are supported idly with respect to the drive shaft 5C, they can rotate at a peripheral speed corresponding to the speed of movement of the continuous flexible elements 27A, that can assume any value, different than the peripheral speed of the cylindrical surfaces 5S of the portions 5P in which the winding roller 5 is divided.

Advantageously, the discs 5D interposed between the portions 5P of the winding roller 5 can have a diameter D1 smaller than the diameter D2 of the cylindrical surfaces 5S of the portions 5P of the winding roller 5. In this way the continuous flexible elements 27A are embedded inside grooves formed in the winding roller 5. Therefore, the web material guided around the cylindrical surface 5S of each portion 5P of the winding roller 5 does not contact the portions of continuous flexible elements 27A guided around the disks 5D.

Figure 9:
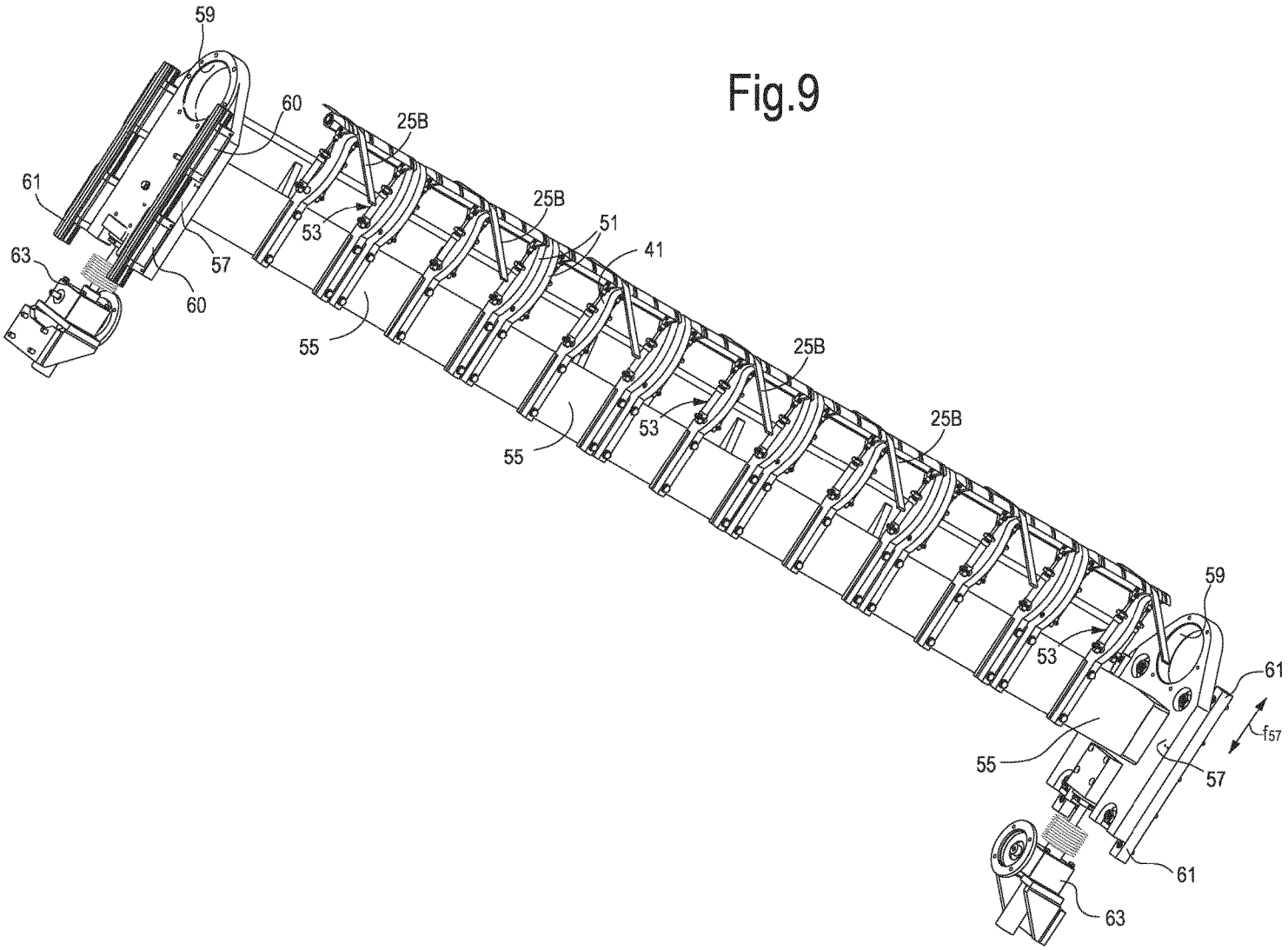
FIG. 9 shows a bottom axonometric view of the pressing device and of the members supporting it.
Figure 10:
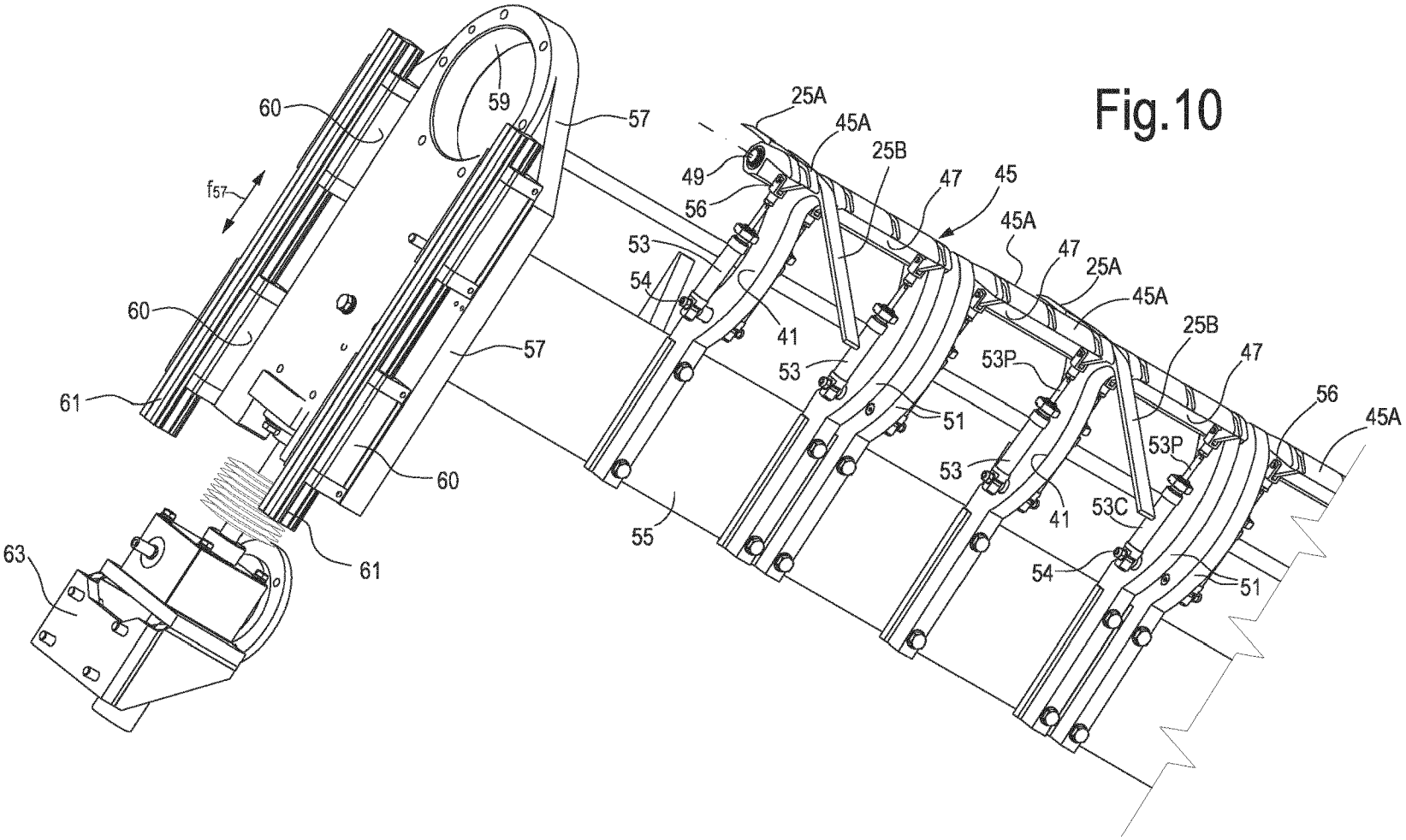
FIG. 10 shows an enlarged view of a detail of FIG. 9.

In some embodiments, the rolling surface 25 can be constituted by a plurality of profiles that can be formed by respective extensions 25A of plates 41 (see FIGS. 9 and 10).

The plates can be fixed to a supporting structure of the rewinding machine, not shown. The plates 41 can be mutually spaced and the rolling surface 25 is formed by a plurality of said extensions 25A.

In some embodiments, each plate 41 can have a second extension 25B which extends from the entrance 19A of the insertion channel 19 towards the zone wherefrom the winding cores A, transported by the supply system 21, arrive. The extensions 25B form an inlet chute, still marked with 25B, for the winding cores A (A1, A2, A3) toward the entrance 19A of the insertion channel 19.

In proximity of the entrance 19A of the insertion channel 19 disposed a pressing device 45 is advantageously, which protrudes with respect to the rolling surface 25 of the cores toward the interior of the insertion channel 19. In the embodiment here described in detail with reference to the accompanying drawings, the pressing device 45 is a movable pressing device and is resiliently biased in a position in which the surface 45A thereof facing toward the separation roller 29 protrudes inside the insertion channel 19, beyond the surface for rolling 25 defined by the profiles or extensions 25A. In advantageous embodiments the position of maximum projection in the insertion channel 19, i.e. of maximum projection with respect to the rolling surface 25, can be adjustable. Ways of regulation are described below.

In other simpler and more economical embodiments, the pressing device 45 can be fixed with respect to the surface for rolling 25. Preferably, also in this simplified embodiment, the pressing device 45 is adjustable.

As shown in particular in FIGS. 9 and 10, in some embodiments the pressing device 45 comprises a plurality of pressing elements 47, substantially equal to each other and transversely aligned with respect to the feed direction of the web material N along the path P and thus approximately parallelly to the rotation axes 5A, 7A of the winding rollers 5 and 7 and of the shaft 33 of the severing roller 29.

Each pressing element 47 can be hinged about a common axis, parallel to the axes 5A, 7A of the winding rollers 5, 7 and to the shaft 33 of the severing roller 29, thereby defining a pressing device hinged around said axis, which can be materialized by a continuous shaft or by coaxial portions of shaft 49.

The continuous shaft or portions of shaft 49 can be supported by the plates 41 and by further plates 51 side by side to the plates 41.

Each pressing element 47 can be associated with at least one resilient biasing member. In the embodiment illustrated in FIGS. 9 and 10 in particular, the intermediate pressing elements 47 are each associated with two resilient biasing members 53, while the terminal pressing element on each side of the pressing device 45 is associated with a single resilient biasing member 53.

In advantageous embodiments, the resilient biasing members 53 can include air springs consisting, for example, of piston-cylinder actuators. For example, the cylinder 53C of each resilient biasing member 53 can be hinged in 54 to the respective plate 41 or 51. The rod 53P of each piston-cylinder actuator, forming resilient biasing member 53, can be hinged in 56 to the respective pressing element 47.

In some embodiments, to adjust the position of the pressing device 45 it is possible to provide that the rods 53P of the air springs 53 have an adjustable length. In this way it is possible to adjust the position of the surface 45A of each pressing element 47 with respect to the rolling surface 25. Alternatively, the one or the other of the points of constraint of the resilient springs 53 can be adjustable.

In modified embodiments, the pressing device 45 can be formed of a single element, formed by formed by a unique element, biased by one or more resilient members, instead of being divided into a plurality of pressing elements 47. The embodiment illustrated with more pressing elements 47 which independently oscillate, is however preferred, because it allows a smoother operation.

As indicated above, in simplified embodiments, not shown, the pressing device 45 can have a fixed position with respect to the surface for rolling 25. In this case, for example, the pressing device 45 can be adjustable in position by tie rods which replace the air springs 53. The tie rods can have an adjustable length, for example by a system of screw and nut or in any other way. Even in this modified embodiment the pressing device 45 can be made of multiple sections, or aligned pressing elements 47, adjustable independently of one another.

When the pressing device 45 is resiliently biased, the antagonist resilient force, which acts on the winding core that is inserted into the insertion channel 19, can be adjustable, for example by varying the fluid pressure inside the air spring 53.

In FIG. 1 the pressing device 45 constituted by the series of pressing elements 47 is placed in the rest position, in which it is biased by the resilient biasing member 53, with the surface 45A partially protruding inside of insertion channel 19. In this way, at the entrance 19A of the insertion channel 19 the distance between the surface 45A of the pressing device 45 (constituted by the set of corresponding surfaces of the pressing elements 47) and the cylindrical surface of the severing roller 29, around which the continuous flexible elements 27 are guided, is less than the height of channel 19 defined by the distance between the rolling surface 25 and the surface defined by the branches of the continuous flexible elements 27A extending between the severing roller 29 and the first winding roller 5.

The plates 41 and 51 can be carried by a transversal beam 55 fixed to its ends to two slides 57 (FIGS. 9 and 10). In advantageous embodiments the slides 57 can also support the second winding roller 7. For such purpose the slides 57 can be provided with seats 59 for supports of the winding roller 7, which in FIGS. 9 and 10 has been removed for the sake of clarity of representation.

The slides 57 can be movably mounted on guides 61 fixed to side walls of the rewinding machine 1 (not shown). The number 60 indicates sliding blocks integral with the slides 57 and engaged with the guides 61. In some embodiments, actuators 63 can be provided to adjust the position of the slides 57 according to the double arrow f57 (see in particular FIGS. 9 and 10). The setting according to the double arrow f57 allows adjusting the position of the second winding roller 7 with respect to the first winding roller 5, and thus the width of the nip 11 as well as the transversal dimension of the insertion channel 19 in a direction orthogonal to the lying plane of the web material N. This adjustment allows adjusting the rewinding machine 1 for different diameter of the winding cores A.

The rewinding machine so far described operates as follows.

In FIG. 1 the roll R1 in the winding cradle 3 is ending its winding around the winding core A1. A successive winding core A2 is ready in a stopping or waiting position in proximity of the entrance 19A of the insertion channel 19. Advantageously, the second winding core A2 rests on a pusher 23A and the entrance chute 25B.

Figure 2:
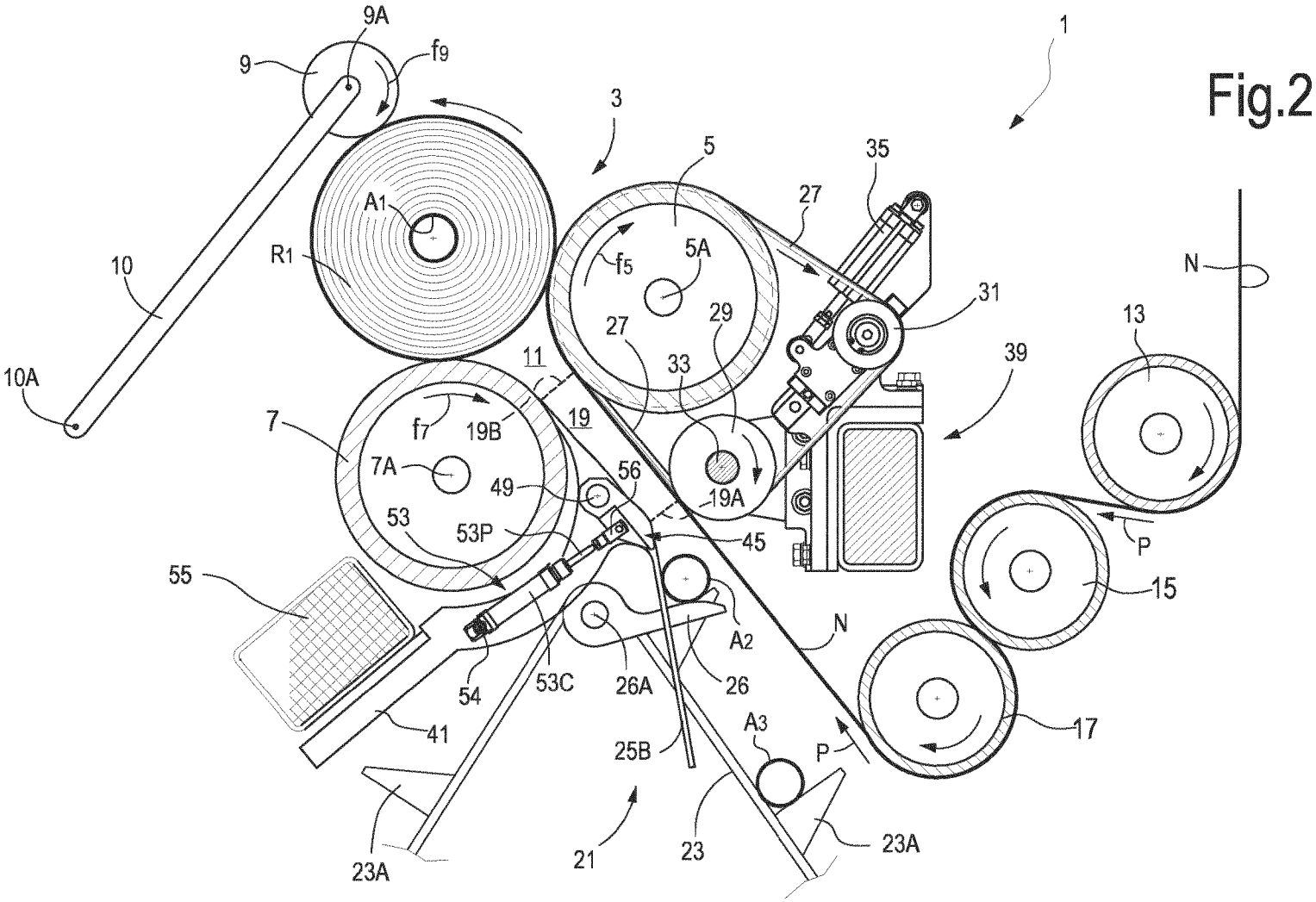

FIG. 2 shows a subsequent stage in which the inserter 26 rotating around the axis 26A picks up the second winding core A2 and begins to approach to the entrance 19A of the insertion channel 19. The roll R1 is still being formed in the winding cradle 3 and in contact with the winding rollers 5, 7 and 9.

Figure 3:
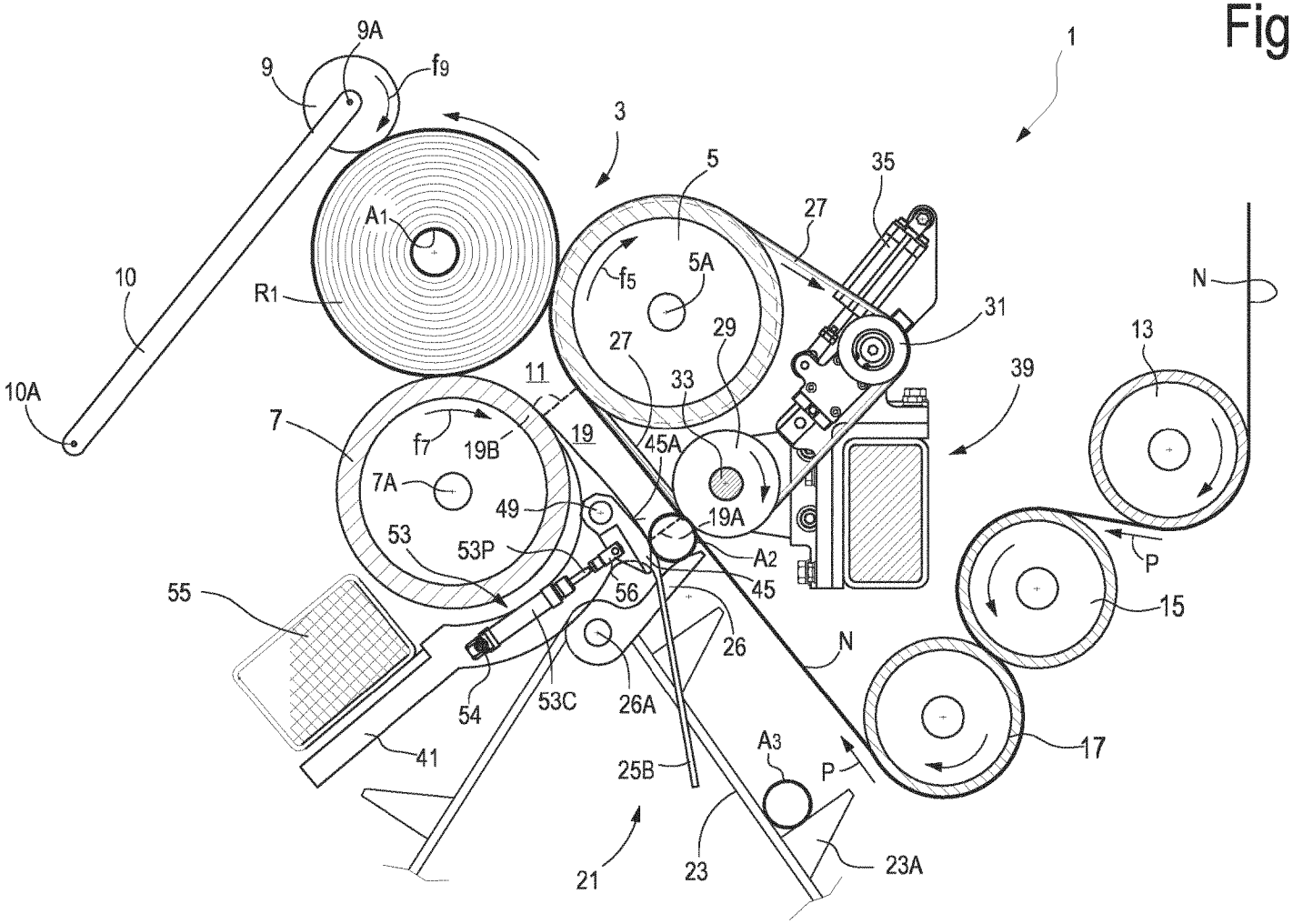

In FIG. 3 the new winding core A2 is inserted by the inserter 26 in the entrance 19A. The diameter of the winding A2 is larger than the dimension of the entrance 19A in the direction orthogonal to the rotation axis of the severing roller 29 and to the feed direction of the web material N. The core A2 is thus forced by the inserter 26 against the upper surfaces of the pressing elements 47, defining the surface 45A of the pressing device 45, and against the web material N at the region in which it is in contact with the severing roller 29 and with the continuous flexible member 27.

In this way the web material N is pinched by the new winding core A2 against the severing roller 29 and against the continuous flexible elements 27A forming the continuous flexible member 27.

As indicated above, the speed of the continuous flexible elements 27A and the peripheral speed of the separation roller 29 are lower, for example of a few percent, than the peripheral speed of the winding roller 5 and therefore of the winding rollers 7 and 9. In consequence of this, due to the pinching of the web material N against the continuous flexible elements 27A and against the severing roller 29, the web material N is slowed down in the area of contact with the winding core A2, while the portion of web material N into contact with the cylindrical surface 5S of the winding roller 5 continues to advance at the winding speed.

Figure 4:
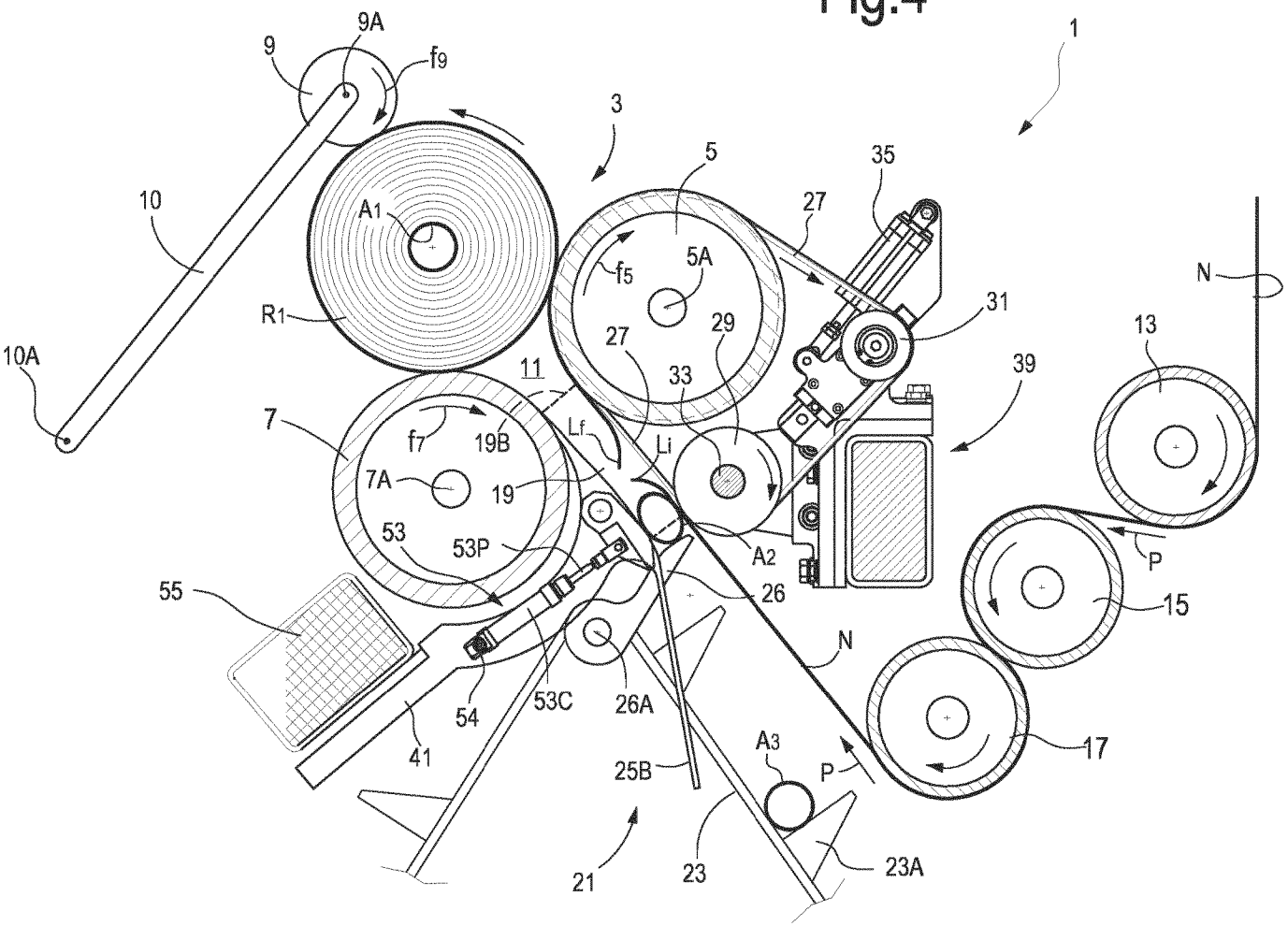

This difference of speed causes that the web material N is stretched up to the limit of rupture. FIG. 4 shows the step in which the web material N is severed. After severing or interruption, the web material N forms a final free edge Lf, which is wound around the roll R1, and an initial free edge or leading edge, which will start winding around the new winding core A2.

In FIG. 4 the winding core A2 starts moving in the insertion channel 19 passing through the entrance 19A thereof. As shown in FIG. 4, the difference between the diametric dimension of the winding core A2 and the distance between the surface 45A and the continuous flexible member 27, or rather the severing roller 29, causes the winding core A2 to temporarily deform taking a substantially elliptical cross section. This deformation generates sufficient friction to cause both the angular acceleration of the winding core A2, which accordingly starts to roll toward the rolling surface 25, and a sufficient pressure against the web material N and the cylindrical surface of the severing roller 29, to cause, thanks to the friction between the web material N on one side and the severing roller 29 and/or the continuous flexible elements 27 on the other side, the tension and the breaking of the web material N. In FIG. 4 the diametrical deformation of the core A2 has been exaggerated compared to the actual conditions for greater clarity of representation.

The resilient biasing members 53 cause a pressure to be exerted on the winding core A2, which is sufficient to cause the resilient deformation for the purposes described above, but avoiding an excessive crushing of the core itself. The resilient deformability of the resilient biasing members 53 determine the capability of the pressing device 45 to move away from the severing roller 29 when the new winding core A2 pass through the entrance 19A of the insertion channel 19. The resilient deformability and the ability of the surface 45A of the pressing device 45 of moving away from the cylindrical surface of the severing roller 29 and from the continuous flexible member 27, allow the rewinding machine to work properly even when the winding cores A have variable diameters due to the unavoidable manufacturing tolerances. The presence of independent pressing elements 47, each provided with its own resilient biasing member 53, also allows adjustment to winding cores A (A1, A2, A3) which can have a diameter variation along their axial extension, for example due to manufacturing defects.

The resilience conferred to the pressing device 45 by the resilient biasing member 53 offsets, in substance, any changes in diameter between one winding core and the other and between different areas of the single winding core. Cores also highly variable in diametric dimension are properly introduced into the insertion channel 19 always reliably obtaining the breakage of the web material N due to the pinching of the web material N between the new winding core A2 and the severing roller 29 and/or the continuous flexible elements 27A. Moreover, as mentioned above, the use of pressing elements with resilient biasing members allows obtaining a smoother operation and less dependent from the greater or lesser rigidity of the winding core. The presence of the pressing elements increases the contact surface with the core and thus makes the angular acceleration of the winding core in the exchange phase more rapid.

Figure 5:
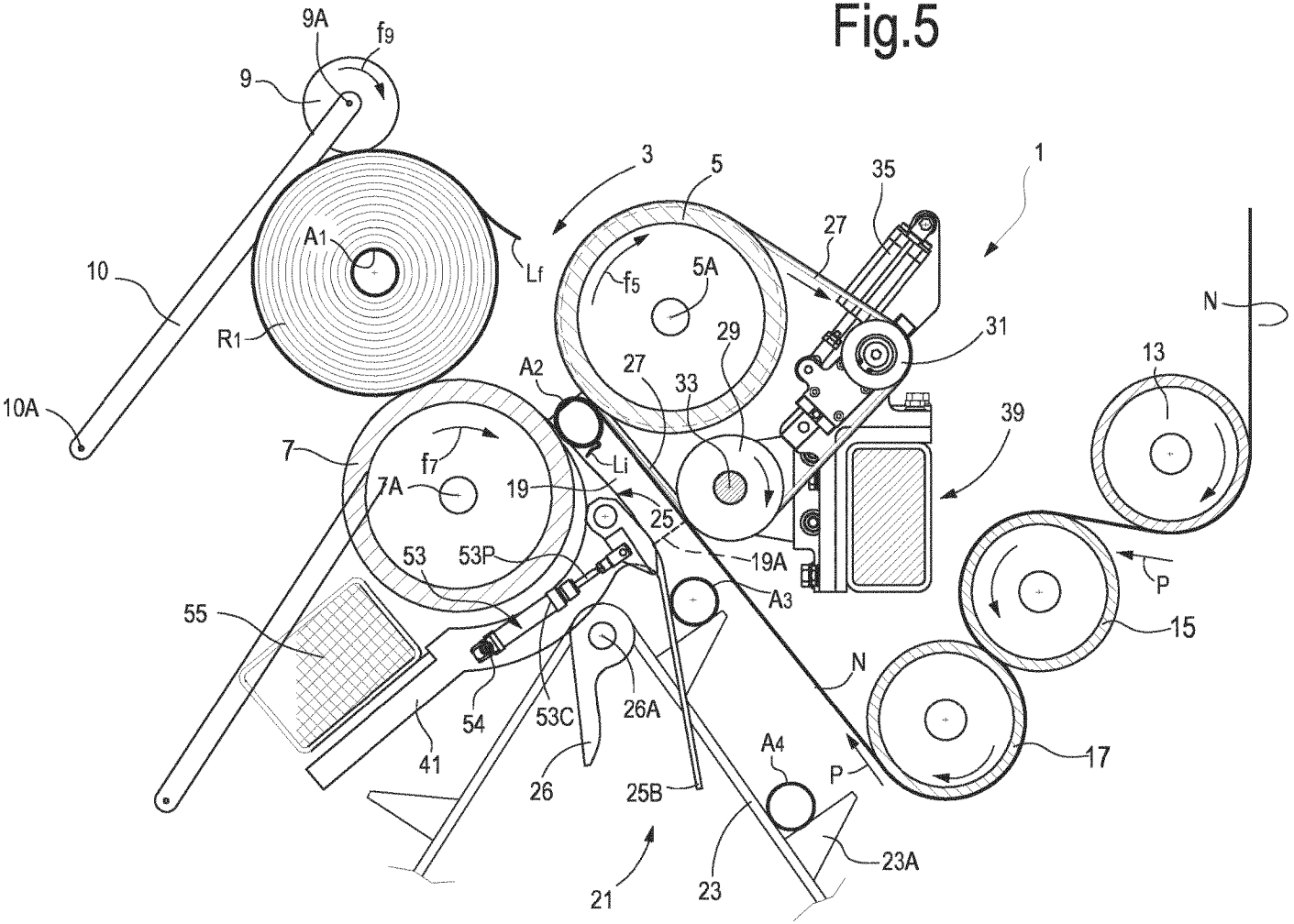

In the subsequent FIG. 5, the new winding core A2 is advanced along the insertion channel 19 and has reached the exit 19B, where the winding core A2 comes into contact with the cylindrical surface of the second winding roller 7 and starts pressing the web material N no longer against the continuous flexible elements 27A of the continuous flexible member 27, but rather against the cylindrical surface 5S of the first winding roller 5.

The roll R1 which has completed in the winding cradle starts to be unloaded from the winding cradle 3 for effect, for example, of a temporary difference of peripheral speed between the second winding roller 7 and the third winding roller 9.

The initial edge Li of the web material is wound around the second winding core A2 for example by providing a line of adhesive applied on the winding core itself, or by means of other systems, for example with air jets (as described in WO 2011/117827), with electrostatic systems, with suction systems or in any other suitable way known to those skilled in the art.

Figure 6:
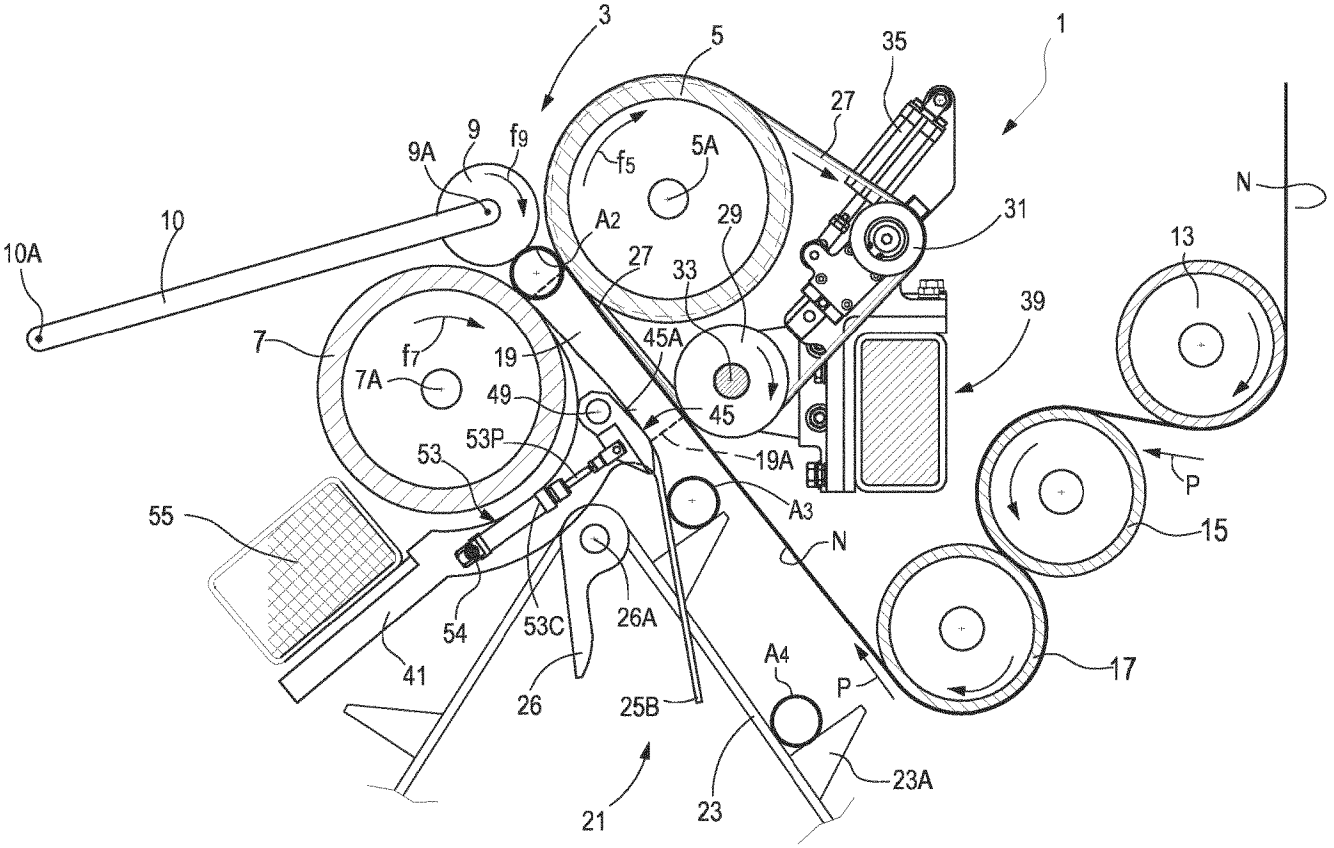

In FIG. 6 the new winding core A2 is almost completely out of the insertion channel 19 and is passing through the nip 11 between the first winding roller 5 and the second winding roller 7. The roll R1 has been unloaded from the winding cradle 3 and the third winding roller 9 can come close to the first winding roller 5 and to the second winding roller 7.

Figure 7:
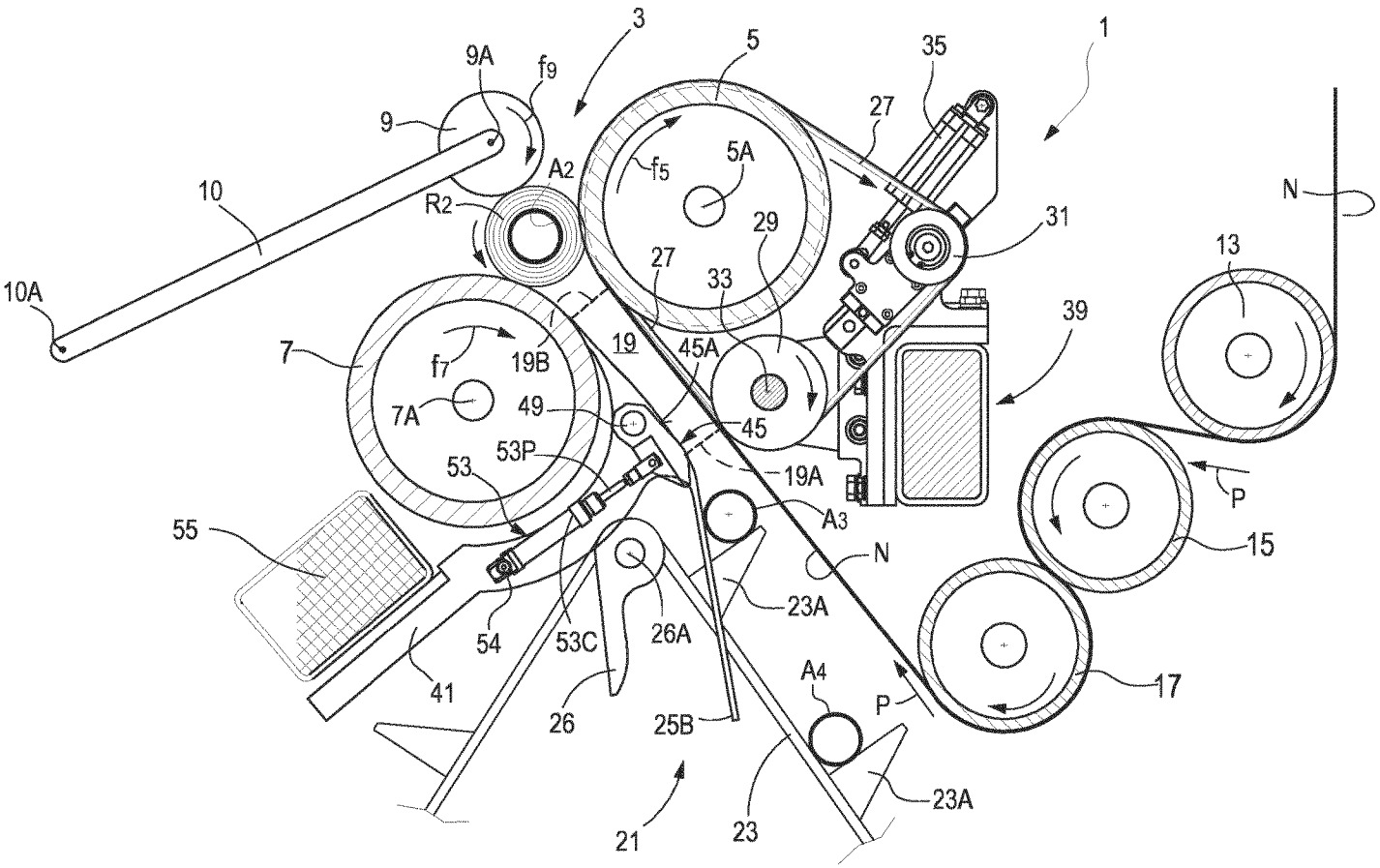

In FIG. 7 the new winding core A2 is coming out from the nip 11 defined between the winding rollers 5 and 7 and a new roll R2 of web material N is being formed there around. The third winding roller 9 has been lowered and has come in contact with the new roll R2. The latter therefore is now in contact with the three winding rollers 5, 7, 9 forming peripheral winding members defining the winding cradle 3.

The passage of the winding core A2 through the nip 11 can be obtained by a speed difference of the winding rollers 5 and 7.

Figure 8:
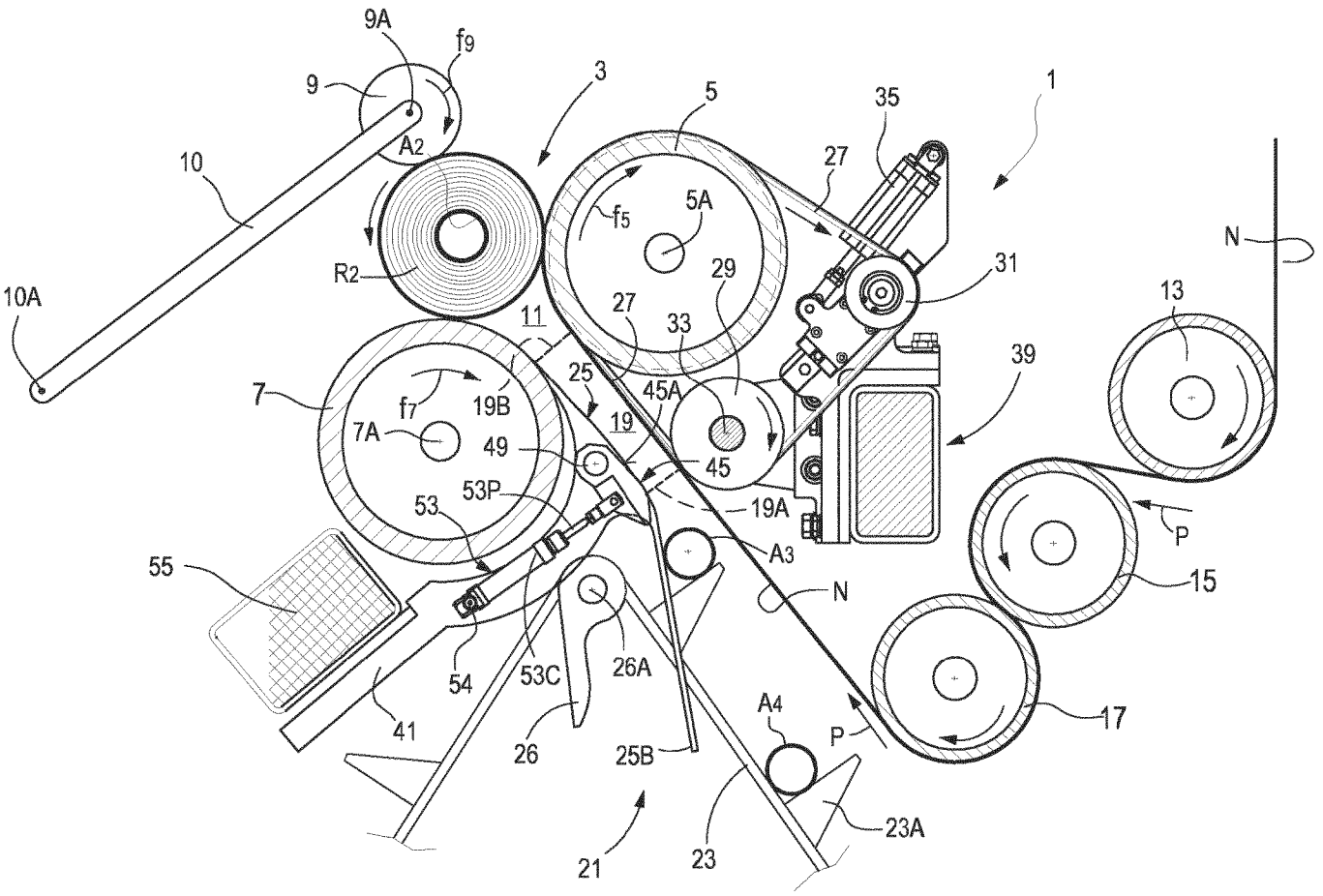

In FIG. 8 the roll R2 is continuing to grow around the winding core A2 in the winding cradle 3 due to the rotation of the winding rollers 5, 7 and 9 at substantially the same peripheral speed.

Figure 12:
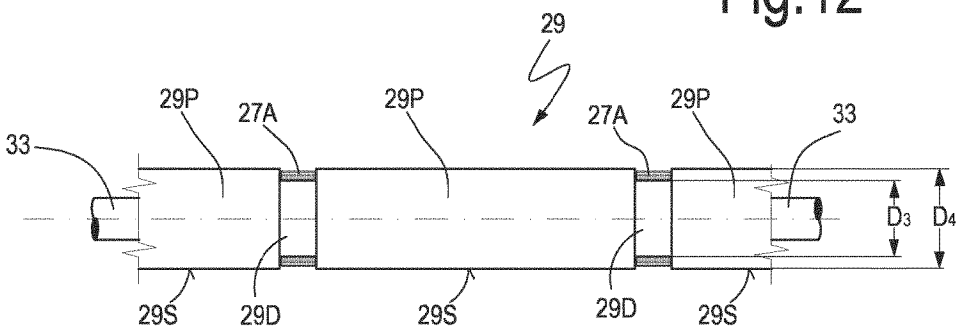
FIG. 12 shows a partial schematic side view of the severing roller and of two belts forming part of the continuous flexible member, guided around the severing roller in a further embodiment

In a different embodiment, the continuous flexible elements 27A that form the continuous flexible member 27 can be moved by the winding roller 5 and move at a peripheral speed corresponding to the peripheral speed of the winding roller 5. However the severing roller 29 can move at a peripheral speed different and independent from the speed of the flexible continuous member 27. For this purpose, as shown in FIG. 12, the severing roller 29 can be constituted by a plurality of roller portions 29P, keyed on a common motorized shaft 33. Between consecutive portions 29P of the severing roller 29 idle pulleys 29D can be placed, which are supported on the roller 33 but are not driven into rotation by it. Around the idle pulleys 29D the continuous flexible elements 27A are guided, which take the motion from the winding roller 5. In FIG. 12 reference D3 indicates the diameter of the idle pulleys 29D, while D4 indicates the outer diameter of the severing roller 29. The two diameters D3 and D4 can be dimensioned in such a way that the continuous flexible elements 27A do not protrude from the outer cylindrical surface 29S of the severing roller 29.

In this embodiment, the separation roller 29 can rotate at peripheral speed a lower than the peripheral speed of the winding roller 5 and the continuous flexible member 27 moves at a speed that can correspond to the peripheral speed of the winding roller 5.

The operation of the rewinding machine in this configuration will be described with reference again to the sequence of FIGS. 1-8.

In FIG. 1 the roll R1 in the winding cradle 3 is ending its winding around the winding core A1. A subsequent winding core A2 is ready in a stopping or waiting position in proximity of the entrance 19A of the insertion channel 19. Advantageously, the second winding core A2 rests on a pusher 23A and on the entrance chute 25B. The flexible elements 27A forming the flexible member 27 are advancing at the peripheral speed of the winding roller which is in turn substantially equal to the feeding speed of the web material N and of its winding around the roll R1 in formation.

In FIG. 2 a subsequent step is shown, in which the inserter 26, rotating about the axis 26A, takes the second winding core A2 and begins to move it to the entrance 19A of the insertion channel 19. The roll R1 is still being wound in the winding cradle 3 and in contact with the winding rollers 5, 7 and 9.

In FIG. 3 the new winding core A2 is inserted by the inserter 26 in the entrance 19A. The diameter of the winding core A2 is larger than the dimension of the entrance 19A in a direction orthogonal to the rotation axis of the severing roller 29 and to the feed direction of the web material N. The winding core A2 is then forced by the inserter 26 against the upper surfaces of the pressing elements 47, defining the surface 45A of the pressing device 45, and against the web material N. As a consequence of this, the web material N is pushed by the winding core A2 against the severing roller 29. The web material is thus pinched between the winding core A2 and the cylindrical surface of the severing roller 29. The latter is rotating at a speed lower than the feeding speed of the web material. For example, the peripheral speed of the severing roller 29 from 5 to 60% lower than the feeding speed of the web material N and of the continuous flexible elements 27A.

In consequence of the difference of speed between the winding roller 5 and the severing roller 8, due to the pinching of the web material N against the severing roller 29, the web material N is slowed down in the area of contact with the winding core A2 and of pinching against the rear severing roller. The portion of web material N into contact with the cylindrical surface 5S of the winding roller 5, and with the continuous flexible member 27 continues to feed at the winding speed. This difference of speed causes the web material N to stretch up to the rupture limit. FIG. 4 shows the step in which the web material N is severed. If the web material is provided with perforation lines, the severing takes place along a perforation line between the roll R1 in the winding step and the pinching point between the core A2 and the severing roller 29.

Following the breaking or severing, the web material N forms a final free edge Lf, which is wound around the roll R1, and an initial free edge or leading edge which will start winding around the new winding core A2.

In FIG. 4 the winding core A2 starts moving in the inserting channel 19 passing through the entrance 19A thereof. As shown in FIG. 4, the difference between the diametric dimension of the winding core A2 and the distance between the surface 45A and the severing roller 29, causes the winding core A2 to temporarily deform assuming a substantially elliptical cross section. This deformation generates a sufficient friction to cause both the angular acceleration of the winding core A2, which consequently begins to roll toward the rolling surface 25, and a sufficient pressure against the web material N and the cylindrical surface of the severing roller 29, to cause, thanks to the friction between the web material N on one side and the severing roller 29 and/or the continuous flexible elements 27 on the other side, the tension and the breaking of the web material N. In FIG. 4 the diameter deformation of the core A2 has been exaggerated with respect to the actual conditions for greater clarity of representation.

The elastic biasing members 53 cause that on the winding core A2 a pressure is exerted that is sufficient to cause the resilient deformation for the purposes described above, while avoiding an excessive crushing of the core itself. The resilient deformability of the elastic biasing members 53 determines the capability of the pressing device 45 to move away from the severing roller 29 when the new winding core A2 passes through the entrance 19A of the insertion channel 19. As in the previous embodiment, the resilient deformability and the possibility of moving away of the surface 45A of the pressing device 45 from the cylindrical surface of the severing roller 29, allows the rewinding machine to work correctly even when the winding cores A have variable diameters due to the unavoidable manufacturing tolerances. The presence of independent pressing elements 47, each provided with its own elastic biasing member 53, also allows an adaptation to winding cores A (A1, A2, A3), which can have a variation in diameter along their axial development, for example, due t manufacturing defects. Moreover, as mentioned earlier, the use of pressing elements with elastic biasing members allows obtaining a smoother operation and less dependent upon the greater or lesser rigidity of the winding core. The presence of the pressing elements increases the contact surface with the core and thus makes the angular acceleration of the winding core in the exchange step more rapid.

Since the flexible elements 27A move at the winding speed, as soon as the winding core A2 comes into contact with the flexible elements 27A leaving the contact with the severing roller 29, its angular speed is controlled by the peripheral speed of the winding roller 5. Once the point of the winding core A2 in contact with the web material N has reached the feeding speed of the latter, the center of the winding core A2 moves along the insertion channel 19 at a speed equal to half the speed of the continuous flexible member 27, which corresponds to the continuous feeding speed of the web material N.

In contrast to the embodiment described above, where the flexible member 27 moves at a speed lower than the winding speed and equal to the speed of the severing roller 29, in this second embodiment there is no slackening of the web material N upstream of the new winding core A2 during feeding of the latter along the insertion channel 19.

In the subsequent FIG. 5, the new winding core A2 is fed along the insertion channel 19 and has reached the exit 19B, where the winding core A2 comes in contact with the cylindrical surface of the second winding roller 7 and starts to press the web material N no longer against the continuous flexible elements 27A of the continuous flexible member 27, but rather against the cylindrical surface 5S of the first winding roller 5.

The roll R1, which has completed its formation in the winding cradle, starts to be unloaded from the winding cradle 3 due to the effect, for example, of a temporary difference of peripheral speed between the second winding roller 7 and the third winding roller 9.

The initial edge Li of the web material is wound around the second winding core A2 for example by providing a line of adhesive applied on the winding core itself, or by means of other systems, for example with air jets (as described in WO 2011/117827), with electrostatic systems, with suction systems or in another suitable way and known to those skilled in the art.

In FIG. 6 the new winding core A2 is almost completely out of the insertion channel 19 and is passing through the nip 11 between the first winding roller 5 and the second winding roller 7. The roll R1 has been unloaded from the winding cradle 3 and the third winding roller 9 can come close to the first winding roller 5 and to the second winding roller 7.

In FIG. 7 the new winding core A2 is coming out from nip 11 defined between the winding rollers 5 and 7 and a new roll R2 of web material N is forming there around. The third winding roller 9 is lowered and it comes into contact with the new roll R2. The latter therefore is now in contact with the three winding rollers 5, 7, 9 forming peripheral winding members defining the winding cradle 3.

Also in this embodiment, the passage of the winding core A2 through the nip 11 can be achieved by a difference between the speed of the winding rollers 5 and 7.

In FIG. 8 the roll R2 is keeping growing around the winding core A2 in the winding cradle 3 due to the rotation of the winding rollers 5, 7 and 9 at substantially equal peripheral speeds.

The embodiments described above and illustrated in the drawings have been discussed in detail as realization examples of the invention. Those skilled in the art will understand that are possible many modifications, variations, additions, and omissions without departing from the principles, concepts and teachings of the present invention as defined in the appended claims. Therefore, the object of the invention should be only determined on the basis of the widest interpretation of the appended claims, comprising in it such modifications, variations, goes, additions and omissions. The terms "to include" and its derivatives do not exclude the presence of additional elements or steps than those explicitly indicated in a determined claim. The term "a" or "an" preceding an element, means or characteristic of a claim does not exclude the presence of a plurality of such elements, means or features. When a claim of device lists a plurality of "means", some or all of such "means" may be implemented by a single component, organ or structure. The wording of certain elements, characteristics or means in different distinct dependent claims does not exclude the possibility of combining together said elements, features or means. When a claim of method lists a sequence of steps, the sequence in which these steps are listed is not binding, and can be changed, if the particular sequence is not indicated as binding. The presence of any reference numbers in the attached claims has the purpose of facilitating reading of the claims with reference to the description and the drawing, and do not limit the object of protection represented by the claims.

The invention claimed is:

1. A rewinding machine for the production of rolls (R1, R2) of web material wound around winding cores (A1-A4), the machine comprising:

a winding cradle (3) comprising peripheral winding members (5, 7, 9) of the rolls;

a feeding path of the web material (N) towards the winding cradle (3);

an insertion channel (19) for inserting the winding cores (A1-A4) towards the winding cradle, having an entrance (19A) inside which the winding cores are introduced and an exit (19B) toward the winding cradle, the insertion channel being defined between a rolling surface (25) and a continuous flexible member (27), provided with a forward movement;

an inserter (26) for inserting the winding cores (A1-A4) into the inserting channel (19);

wherein at the entrance (19A) of the insertion channel (19) a pressing device (45) is arranged, which projects toward the inside of the insertion channel (19) and toward the continuous flexible member (27); wherein the pressing device (45) is arranged and configured to press the winding cores entering the insertion channel (19) towards the continuous flexible member (27), wherein the continuous flexible member (27) is guided around a severing roller (29) arranged at the entrance (19A) of the feeding channel (19) and around a winding member (5) forming part of the peripheral winding members, wherein the continuous flexible member (27) is driven into motion by means of the winding member (5) around which the continuous flexible member (27) is guided; and wherein the severing roller (29) rotates at a peripheral speed controlled so that, at least in a step of inserting a winding core (A1-A4) in the insertion channel (19), the peripheral speed of the severing roller (29) is lower than the peripheral speed of the winding member (5), the severing roller being associated with guiding members of the flexible continuous member comprising pulleys interposed between portions of the severing roller allowing said continuous flexible member (27) to have a feed speed different from the peripheral speed of the severing roller (29).

2. The rewinding machine according claim 1, wherein the position of the pressing device (45) with respect to the rolling surface (25) can be adjusted.

3. The rewinding machine according to claim 1, wherein the pressing device (45) is movable with respect to the continuous flexible member (27) and with respect to the rolling surface (25), so as to move away from the continuous flexible member (27) when a winding core is inserted in the insertion channel (19), between the continuous flexible member (27) and the pressing device (45).

4. The rewinding machine according to claim 1, wherein the pressing device (45) is arranged in front of the severing roller (29), the winding cores (A1-A4) being forced and inserted between the severing roller (29) and the pressing device (45).

5. The rewinding machine according to claim 1, wherein the pressing device (45) is arranged and configured such that the passage of the winding cores (A1-A4) into the inserting channel (19) causes a movement of the pressing device (45) away from the continuous flexible member (27).

6. The rewinding machine according to claim 5, wherein the pressing device (45) is hinged around an oscillation axis (49) substantially orthogonal to the feed direction of the web material (N) and to the feed direction of the winding cores (A1-A4) in the insertion channel (19).

7. The rewinding machine according to claim 1, wherein the pressing device (45) is resiliently biased in an idle position, in which it projects inside the insertion channel (19), the passage of the winding cores in the insertion channel (19) causing a movement of the pressing device (45) away from the continuous flexible member (27) against an elastic antagonistic force.

8. The rewinding machine according to claim 1, comprising a chute (25B) for conveying the winding cores (A1-A4) towards the entrance (19A) of the insertion channel (19), said chute (25B) extending upstream of the pressing device (45) with respect to the feed direction of the winding cores.

9. The rewinding machine according to claim 1, comprising a winding core feeding system, feeding the winding cores towards the insertion channel (19), and wherein the feeding system comprises: a conveyor (23, 23A) feeding the winding cores in a waiting position in front of the entrance (19A) of the insertion channel (19); the inserter (26) of the winding cores transferring the winding cores from the waiting position to the entrance (19A) of the insertion channel (19).

10. A rewinding machine for the production of rolls (R1, R2) of web material wound around winding cores (A1-A4), the machine comprising:

a winding cradle (3), comprising peripheral winding members (5, 7, 9) of the rolls;

a feeding path of the web material (N) towards the winding cradle (3);

an insertion channel (19) for inserting the winding cores (A1-A4) towards the winding cradle, having an entrance (19A) inside which the winding cores are introduced and an exit (19B) toward the winding cradle, the insertion channel being defined between a rolling surface (25) and a continuous flexible member (27), provided with a forward movement;

an inserter (26) for inserting the winding cores (A1-A4) into the inserting channel (19);

wherein at the entrance (19A) of the insertion channel (19) a pressing device (45) is arranged, which projects toward the inside of the insertion channel (19) and toward the continuous flexible member (27);

wherein the pressing device (45) is arranged and configured to press the winding cores entering the insertion channel (19) towards the continuous flexible member (27), wherein the continuous flexible member (27) is guided around a severing roller (29) arranged at the entrance (19A) of the feeding channel (19) and around a winding member (5) forming part of the peripheral winding members, wherein the continuous flexible member (27) is driven into motion by the severing roller (29) around which the continuous flexible member is guided; and wherein the severing roller rotates at a peripheral speed controlled so that, at least in a step of inserting a core in the inserting channel, the peripheral speed of the severing roller (29) is lower than the peripheral speed of the winding member (5), the winding member (5) being associated with guide rollers of the continuous flexible member allowing said continuous flexible member to have a feed speed different from the peripheral speed of the winding member (5).

11. The rewinding machine according claim 10, wherein the position of the pressing device (45) with respect to the rolling surface (25) can be adjusted.

12. The rewinding machine according to claim 10, wherein the pressing device (45) is movable with respect to the continuous flexible member (27) and with respect to the rolling surface (25), so as to move away from the continuous flexible member (27) when a winding core is inserted in the insertion channel (19), between the continuous flexible member (27) and the pressing device (45).

13. The rewinding machine according to claim 10, wherein the pressing device (45) is arranged in front of the severing roller (29), the winding cores (A1-A4) being forced and inserted between the severing roller (29) and the pressing device (45).

14. The rewinding machine according to claim 10, wherein the pressing device (45) is arranged and configured such that the passage of the winding cores (A1-A4) into the inserting channel (19) causes a movement of the pressing device (45) away from the continuous flexible member (27).

15. The rewinding machine according to claim 10, wherein the pressing device (45) is resiliently biased in an idle position, in which it projects inside the insertion channel (19), the passage of the winding cores in the insertion channel (19) causing a movement of the pressing device (45) away from the continuous flexible member (27) against an elastic antagonistic force.

16. The rewinding machine according to claim 10, comprising a chute (25B) for conveying the winding cores (A1-A4) towards the entrance (19A) of the insertion channel (19), said chute (25B) extending upstream of the pressing device (45) with respect to the feed direction of the winding cores.

17. The rewinding machine according to claim 10, comprising a winding core feeding system, feeding the winding cores towards the insertion channel (19), and wherein the feeding system comprises: a conveyor (23, 23A) feeding the winding cores in a waiting position in front of the entrance (19A) of the insertion channel (19); the inserter (26) of the winding cores transferring the winding cores from the waiting position to the entrance (19A) of the insertion channel (19).

18. A rewinding machine for the production of rolls (R1, R2) of web material wound around winding cores (A1-A4), the machine comprising:

a winding cradle (3), comprising peripheral winding members (5, 7, 9) of the rolls;

a feeding path of the web material (N) towards the winding cradle (3);

an insertion channel (19) for inserting the winding cores (A1-A4) towards the winding cradle, having an entrance (19A) inside which the winding cores are introduced and an exit (19B) toward the winding cradle, the insertion channel being defined between a rolling surface (25) and a continuous flexible member (27), provided with a forward movement;

an inserter (26) for inserting the winding cores (A1-A4) into the inserting channel (19);

wherein at the entrance (19A) of the insertion channel (19) a pressing device (45) is arranged, which projects toward the inside of the insertion channel (19) and toward the continuous flexible member (27); wherein the pressing device (45) is arranged and configured to press the winding cores entering the insertion channel (19) towards the continuous flexible member (27), wherein the pressing device (45) is resiliently biased in an idle position, in which it projects inside the insertion channel (19), the passage of the winding cores in the insertion channel (19) causing a movement of the pressing device (45) away from the continuous flexible member (27) against an elastic antagonistic force, wherein the pressing device (45) comprises a plurality of mutually aligned pressing elements (47), and wherein the pressing elements (47) are movable one independently to the other and each of them is provided with at least one resilient biasing member (53) biasing the respective pressing element (47) in said idle position.

19. The rewinding machine according to claim 18, wherein the pressing elements (47) are hinged around a common oscillation axis.

20. The rewinding machine according to claim 18, wherein each pressing element (47) is arranged between two substantially parallel plates (41) and hinged thereto, the respective resilient biasing member (53) of the pressing element (47) being arranged between the plates, at least one of said plates being provided with a first extension (25A) defining the rolling surface (25) of the winding cores (A1-A4);

and wherein at least one of said plates (41) has a second extension (23) forming a slide for conveying the winding cores (A1-A4) towards the entrance (19A) of the insertion channel (19).

21. A method for producing rolls (R1, R2) of web material wounded around winding cores (A1-A4), comprising:

providing a winding cradle (3), comprising peripheral roll winding members (5, 7, 9);

providing a feeding path of the web material (N) towards the winding cradle (3);

providing an insertion channel (19) for inserting the winding cores towards the winding cradle (3), having an entrance (19A) where the winding cores (A1-A4) are inserted and an exit (19B) towards the winding cradle (3), the insertion channel (19) being defined between a rolling surface (25) and a continuous flexible member (27), provided with a forward movement;

providing, at the entrance (19A) of the insertion channel (19) for the winding cores, a pressing device (45) projecting towards the inside of the insertion channel (19);

providing an inserter (26) configured for inserting the winding cores (A1-A4) in the insertion channel (19);

feeding the web material (N) along the feeding path of the web material towards the winding cradle (3) and winding a first roll (R1) of web material (N) around a first winding core (A1);

when the first roll (R1) of web material has been completely wound, inserting by means of said inserter (26) a new winding core into the entrance (19A) of the insertion channel (19), between the continuous flexible member (27) and the pressing device (45) so that the new winding core (A1) is pressed toward the continuous flexible member (27) by the pressing device (45), said method further comprising:

guiding the continuous flexible member (27) around a winding roller (5) forming part of the winding cradle (3) and around a severing roller (29) arranged at the entrance (19A) of the insertion channel (19) for the winding cores;

at least during the step of inserting the new winding core (A2), rotating the severing roller (29) at a peripheral speed lower than a peripheral speed of the winding roller (5);

pressing the new winding core by means of the pressing device (45) against the severing roller (29), generating a tension in the web material due to the effect of the difference between the speed of the severing roller (29) and that of the winding roller (5), the tension causing the web material (N) to be severed.

22. The method according to claim 21 wherein: the continuous flexible member (27) is driven into motion by means of the winding roller (5) and moved forward at a speed determined by the speed of rotation of the winding roller (5); or the continuous flexible member (27) is driving into motion by the severing roller (29) and moves forward at a speed determined by the speed of rotation of the severing roller.

* * * * *